US011633048B2

(12) United States Patent
Grothaus

(10) Patent No.: US 11,633,048 B2
(45) Date of Patent: Apr. 25, 2023

(54) POCKET-SPRING CORE AND METHOD FOR PRODUCING THE POCKET-SPRING CORE

(71) Applicant: AGRO HOLDING GMBH, Bad Essen (DE)

(72) Inventor: Sabine Grothaus, Bad Essen (DE)

(73) Assignee: AGRO HOLDING GMBH, Bad Essen (DE)

( * ) Notice: Subject to any disclaimer, the term of this patent is extended or adjusted under 35 U.S.C. 154(b) by 88 days.

(21) Appl. No.: 16/342,327

(22) PCT Filed: Oct. 9, 2017

(86) PCT No.: PCT/EP2017/075669

§ 371 (c)(1),
(2) Date: Apr. 16, 2019

(87) PCT Pub. No.: WO2018/073035

PCT Pub. Date: Apr. 26, 2018

(65) Prior Publication Data

US 2019/0274444 A1 Sep. 12, 2019

(30) Foreign Application Priority Data

Oct. 17, 2016 (DE) ..... 102016119742.4

(51) Int. Cl.
*A47C 27/06* (2006.01)
*B68G 9/00* (2006.01)

(52) U.S. Cl.
CPC ..... *A47C 27/062* (2013.01); *A47C 27/064* (2013.01); *B68G 9/00* (2013.01)

(58) Field of Classification Search
CPC ..... A47C 27/062; A47C 27/064; B68G 9/00
(Continued)

(56) References Cited

U.S. PATENT DOCUMENTS 3,626,523 A * 12/1971 Robins ..... A47C 27/062 5/716
5,868,383 A * 2/1999 Codos ..... B68G 9/00 267/166.1

(Continued)

FOREIGN PATENT DOCUMENTS

AU 2014101362 12/2014
DE 102013107255 1/2015

(Continued)

OTHER PUBLICATIONS

Search Report issued in Int'l App. No. PCT/EP2017/075669 (dated 2017).

*Primary Examiner* — Myles A Throop
(74) *Attorney, Agent, or Firm* — Barnes & Thornburg LLP

(57) ABSTRACT

A pocket-spring core having at least one first zone and at least one second zone, wherein the first zone has at least two rows of a first spring portion and at least one of the second zones has at least one row or line of a second spring portion, wherein the second spring portion has at least two layers which are located vertically one above the other and comprise in each case a plurality of helically wound first compression springs, in a first, upper layer, and second compression springs, in a second, lower layer, and at least one row of a third spring portion, is distinguished in that at least one of the second zones of the pocket-spring core has at least one channel-like depression.

15 Claims, 2 Drawing Sheets

(58) Field of Classification Search
USPC ..... 5/717, 720
See application file for complete search history.

(56) References Cited

U.S. PATENT DOCUMENTS

| | | | | |
|---|---|---|---|---|
| 6,256,820 | B1 * | 7/2001 | Moser | A47C 27/062 267/166 |
| 6,353,952 | B1 * | 3/2002 | Wells | A47C 27/062 5/716 |
| 6,523,812 | B1 * | 2/2003 | Spinks | A47C 27/001 267/166 |
| 6,813,791 | B2 * | 11/2004 | Mossbeck | A47C 27/064 5/716 |
| 6,826,796 | B1 * | 12/2004 | Mossbeck | A47C 23/0433 5/655.8 |
| 7,194,777 | B2 * | 3/2007 | Edling | A47C 27/064 5/720 |
| 8,590,082 | B2 * | 11/2013 | Mantzis | A47C 27/064 5/720 |
| 9,332,856 | B2 * | 5/2016 | Eigenmann | A47C 7/746 |
| 9,603,460 | B2 * | 3/2017 | DeFranks | A47C 27/064 |
| 10,076,193 | B2 * | 9/2018 | Long | B29C 65/4815 |
| 10,172,472 | B2 * | 1/2019 | Long | B29C 66/81433 |
| 10,905,246 | B2 * | 2/2021 | Thomas | A47C 27/064 |
| 2003/0074736 | A1 * | 4/2003 | Grothaus | A47C 23/0433 5/655.8 |
| 2003/0218285 | A1 * | 11/2003 | Grothaus | A47C 27/062 267/142 |
| 2004/0025256 | A1 * | 2/2004 | Mossbeck | A47C 27/062 5/655.8 |
| 2004/0128773 | A1 * | 7/2004 | Barber | F16F 1/08 5/716 |
| 2009/0222985 | A1 * | 9/2009 | Richmond | A47C 27/053 5/247 |
| 2010/0139006 | A1 * | 6/2010 | Kilic | A47C 27/064 5/720 |
| 2010/0257675 | A1 * | 10/2010 | DeMoss | A47C 27/064 5/720 |
| 2011/0148018 | A1 * | 6/2011 | DeFranks | A47C 27/064 267/166.1 |
| 2016/0157626 | A1 | 6/2016 | Grothaus | |
| 2018/0049559 | A1 * | 2/2018 | Jewett | A47C 27/062 |

FOREIGN PATENT DOCUMENTS

| | | |
|---|---|---|
| EP | 1603434 | 7/2008 |
| KR | 101423565 | 8/2014 |
| WO | WO 03/096847 | 11/2003 |
| WO | WO 2014/207634 | 12/2014 |

* cited by examiner

POCKET-SPRING CORE AND METHOD FOR PRODUCING THE POCKET-SPRING CORE

CROSS-REFERENCE TO RELATED APPLICATIONS

This application is a U.S. nationalization under 35 U.S.C. § 371 of International Application No. PCT/EP2017/075669, filed 9 Oct. 2017, which claims priority to German Patent Application No. 102016119742.4, filed 17 Oct. 2016. The disclosures set forth in the referenced applications are incorporated herein by reference in their entireties.

BACKGROUND AND SUMMARY OF THE DISCLOSURE

The present disclosure is directed to a pocket spring core, a mattress or a cushion having such a pocket spring core, and a method for producing such a pocket spring core.

Embodying pocket spring cores having zones of different stiffness in portions is known. The zones of the pocket spring core can thus be embodied having reduced or reinforced stiffness for individual body parts of a sleeper, for example, the shoulders, the feet, or the buttocks in comparison to other body parts.

A method is known from EP 1 603 434 B1, in which spring strands, which are located adjacent to one another and differ in the height thereof, from pocketed springs are connected to one another. Partial gaps thus result in the surface of the pocket spring core which are filled by filler material. This filler material can consist of spring strands from pocketed springs joined together to form a partial spring core, the springs of which are dimensioned in the height thereof such that the gaps are filled and a substantially planar reclining surface results.

For this purpose, the individual partial pocket spring cores, i.e., those having springs each of different heights and also those which fill a gap, are each produced separately, wherein in each case previously formed equivalent spring strands from pocketed springs are connected to one another, for example, by adhesive bonding.

The respective gap-filling partial spring core is laid in the gap formed and the thus completed pocket spring core is subsequently provided with one or more padding layers and/or enveloped with a material so that a pocket spring core mattress or a cushion having zones of different stiffness results.

The technical teaching of EP 1 603 434 B1 has the disadvantage of the separate manufacturing of the respective spring strands from pocketed springs, which subsequently first have to be manually joined or assembled to form a partial spring core and then to form the overall spring core. Complex manufacturing having correspondingly high costs thus results in particular due to the production-logistical expenditure and the handling effort, which is typically to be performed manually.

The joining together of separately manufactured pocket spring strands each having different springs, in particular springs of different heights to produce a zoned pocket spring core, was automated by a device by the technical teaching of DE 10 2013 107 255 A1. The costs for the production of a zoned pocket spring core could thus already be significantly reduced in comparison to EP 1 603 434 B1.

The solution of DE 10 2013 107 255 A1 has the disadvantage of the still necessary separate manufacturing of the required pocket spring strands each having different springs, in particular springs of different heights for producing a zoned pocket spring core.

A zoned pocket spring core is disclosed in WO 03/096847 A1, in which two different springs, in particular springs of different heights, are each used in one pocket, wherein the respective pockets of the different springs are arranged vertically one over the other, so that one pocket spring core having pocket spring strand sections results and each pocket spring strand section has at least two layers of pocketed springs, in which the pockets of each spring are each closed by weld seams.

A complete pocket spring strand section or a complete spring strand having two or more layers of different springs, in particular springs having different heights, can be created in one work step by the technical teaching of WO 03/096847 A1. WO 03/096847 A1 thus overcomes the disadvantage of the respective separate manufacturing of pocket spring cores each having different springs.

A zoned pocket spring core according to the present disclosure may be more simply and cost-effectively producible in comparison to the prior art.

A pocket spring core according to the present disclosure may include multiple zones, at least one of which have a lower stiffness than other zones or another zone of the pocket spring core, to at least partially create the lower stiffness of this/these zone(s) by defined omission of springs. This may yield a lower cost pocket spring core.

In one embodiment, the channel-like depressions extend through the entire width of the pocket spring core. Advantageously simple, uncomplicated manufacturing and thus a cost-optimum zoned pocket spring core may therefore result.

In another embodiment, the second spring strand section has three layers located vertically one over another of respectively a plurality of helical wound first compression strings in a first upper layer, second compression springs in a second, middle layer, and first compression springs in a third, lower layer. A part of a zone having comparatively lower stiffness can thus advantageously be manufactured in an automated manner.

The height of the second spring strand section advantageously corresponds to the height of the first spring strand section. An optimized support by the zoned pocket spring core thus results.

In a further embodiment, the height of the third spring strand section is less than the height of the first spring strand section and also less than the height of the second spring strand section.

The textile material of which the pockets are made, in which the compression springs of the spring strand sections are pocketed, may be nonwoven material. This may yield cost-effective producibility of the zoned pocket spring core.

In yet another embodiment, the pocket is closed in each case by horizontal weld seams and vertical weld seams. Automated manufacturing of the spring strands having short cycle times is advantageously achieved by the weld seams.

The weld seams may be produced by an ultrasonic welding method. This may yield relatively simple and cost-effective manufacturing of the zoned pocket spring core.

In a further embodiment, the second spring strand section and the third spring strand section of the second zone are arranged in a pattern. The second zone advantageously has a pattern of in each case a single or multiple successive second spring strand section(s), which is/are followed by a single or multiple successive third spring strand section(s).

The zoning of the pocket spring core may be implemented in a manner which can be automated and simplified by the arrangement of the spring strands in a defined pattern.

BRIEF DESCRIPTION OF THE DRAWINGS

Exemplary embodiments of the subject matter according to the disclosure are illustrated in the drawings and will be described in greater detail hereafter. In the figures:

FIG. 1 shows a front view of a zoned pocket spring core 1. The pocket spring core 1 accordingly has at least one first zone 2 and at least one second zone 3. The first zone 2 differs from the second zone 3 due to its stiffness, wherein the term "stiffness" means the resistance to (elastic) deformation here.

Figure 1:
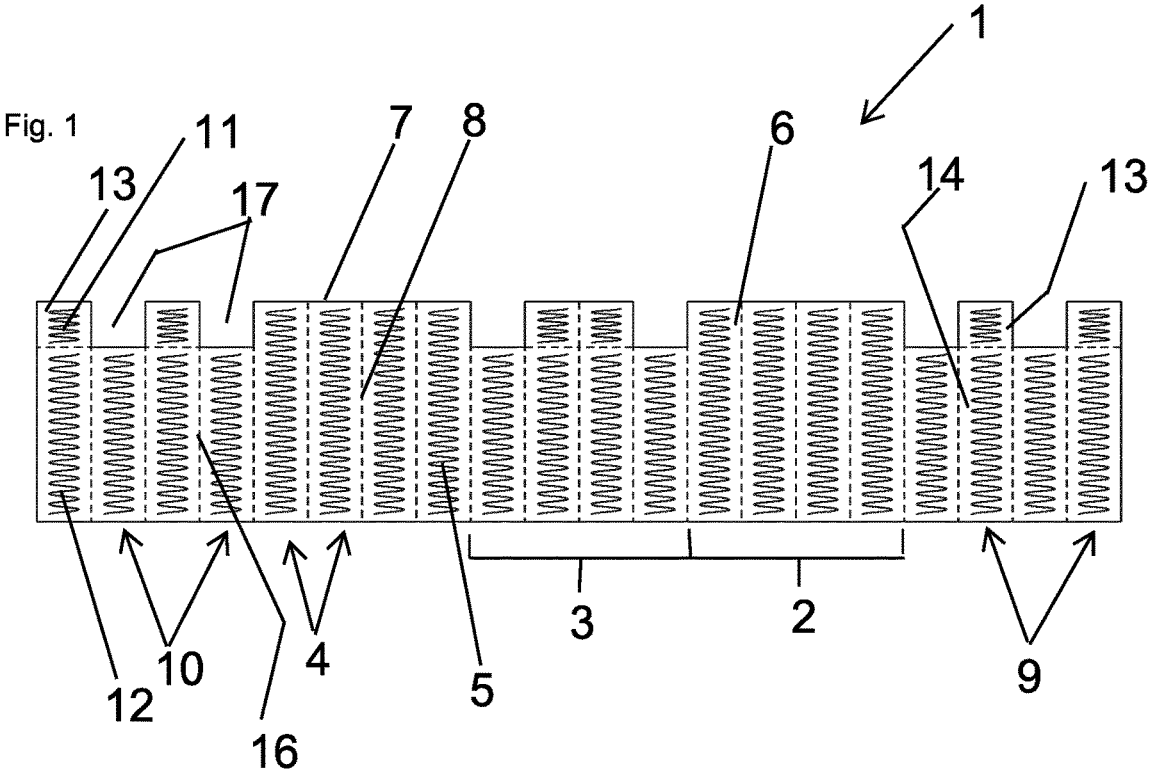
FIG. 1: shows a front view of a zoned pocket spring core according to the disclosure.

The first zone 2 has at least two rows or lines of a first spring strand section 4. The first spring strand section 4 has a plurality of equivalent, helical wound compression springs 5, which are each individually inserted into a pocket 6 enclosing the individual compression spring 5.

The term "row" or "line" refers to a direction transverse or perpendicular to the greatest longitudinal extension of the finished zoned pocket spring core 1.

The pocket 6 is produced in each case from a planar textile material, for example, a nonwoven material, wherein the pocket 6—in relation to the plane of the drawing of FIG. 1—is closed in each case by horizontal weld seams 7 and vertical weld seams 8. The weld seams 7, 8 are produced here by an ultrasonic welding method. Alternatively, other welding methods are also possible for producing the weld seams 7, 8.

A spring strand made of respective individual pocketed compression springs 5 is typically produced as a quasi-endless strand in an automated process by a machine.

The at least two rows or lines of the first spring strand section 4, which form the first zone 2 of the pocket spring core 1, are each formed by cutting the endless strand to length to form the first spring strand section 4. The cutting to length is performed in each case in the region of the vertical weld seam 8 between two pockets 6 so that the respective pockets 6 are not damaged. The at least two rows or lines of the first spring strand section 4, which form the first zone of the pocket spring core 1, are formed by aligning, layering, and adhesively bonding the contact points of the spring strand sections 4, which are aligned and layered in rows or lines.

The cutting to length of the strands to form the respective spring strand sections 4, and the alignment, juxtaposing, and adhesive bonding of the spring strand sections 4 are also performed in an automated process by a machine.

At least one of the second zone(s) 3 of the zoned spring core 1 has at least one row or line of a second spring strand section 9 and at least one row or line of a third spring strand section 10.

The second spring strand section 9 and the third spring strand section 10 are arranged in a pattern. A simple alternating pattern is selected as the pattern in FIG. 1 by way of example. After a single second spring strand section 9, a single third spring strand section 10 thus follows, on which a single second spring strand section 9 again follows, etc.

Alternatively, other patterns are also possible in the arrangement of the second spring strand section 9 and the third spring strand section 10 in the second zone 3 of the zoned pocket spring core 1. It is thus also possible, for example, that the second zone 3 has a pattern of respectively one single or multiple successive second spring strand sections 9, which is/are followed by one single or multiple successive third spring strand sections 10.

The second spring strand section 9 has at least two layers located vertically one over another in relation to the plane of the drawing of FIG. 1, of in each case a plurality of helical wound first compression springs 11 in a first upper layer and second compression springs 12 in a second lower layer, which are each inserted individually into a pocket 13 enclosing the respective individual first compression spring 11 and the pocket 14 each enclosing individual second compression springs 12.

The pockets 13, 14 are produced from a planar textile material, for example, a nonwoven material, wherein the pockets 13, 14—with respect to the plane of the drawing of FIG. 1—are each closed by horizontal weld seams 15 and vertical weld seams 16. The weld seams 15, 16 are produced here by an ultrasonic welding method. Alternatively, other welding methods are also possible for producing the weld seams 15, 16.

The height of the second spring strand section 9—i.e., its dimension in the vertical direction in relation to the plane of the drawing of FIG. 1—corresponds to the height of the first spring strand section 4.

A spring strand made in each case of two layers of individual pocketed compression springs 11, 12 is typically produced as a quasi-endless strand in an automated process by a machine.

The compression springs 11, 12 differ here due to the height thereof—i.e. the dimension thereof in the vertical direction in relation to the plane of the drawing in FIG. 1—and the turn pitch. The second compression spring 12 has a higher stiffness than the first compression spring 11.

The first compression spring 11 and the second compression spring 12 of the second spring strand section 9 are arranged vertically one over another. Both compression springs 11, 12 thus act in the event of a load in the direction of the arrow "F" in FIG. 1 like a series circuit of compression springs. An overall stiffness of an imaginary equivalent spring of this series circuit thus results which is lower than the stiffness of the first compression spring 11 having the lowest individual stiffness of the series circuit of the compression springs 11, 12. Due to the series circuit of the compression springs 11, 12, a progressive spring constant thus results—at least approximately—of the imaginary equivalent spring.

The third spring strand section 10 is constructed similarly to the first spring strand section 4 here. Therefore, only the differences and additions in relation to the first spring strand section 4 will be described to avoid repetitions. The third spring strand section 10 has a plurality of equivalent, helical wound second compression springs 12, which are each inserted individually here into a pocket 14 enclosing the individual second compression spring 12. The second compression spring 12 of the third spring strand section 10 has a lower turn pitch and a lesser height in comparison to the compression spring 5 of the first spring strand section 4.

Alternatively, the third spring strand section 10 can also have multiple layers of compression springs which are arranged vertically one over another. Each layer has, in this case, a plurality of equivalent helical wound compression springs in each case, which are each individually inserted into a pocket enclosing the individual compression springs.

It is essential that the height of the third spring strand section 10 is less than the height of the first spring strand section 4 and also less than the height of the second spring strand section 9.

Due to the pattern, which is formed by the arrangement of the second spring strand section 9 and the third spring strand section 10 here, at least one of the second zone(s) 3 of the pocket spring core 1 has channel-like depressions 17. The channel-like depressions may extend through the entire width of the pocket spring core 1. A cost-optimized zoned pocket spring core 1 may thus result. "Width" means the dimension of the pocket spring core 1 perpendicular to the plane of the drawing of FIG. 1.

The second zone(s) 3—in particular that/those having the channel-like depressions 17—has a significantly lower stiffness than the first zone 2 of the spring core 1 and is therefore arranged in regions of the spring core 1 in which specific body parts (for example, shoulders or buttocks) of a sleeper are to plunge more deeply into the spring core 1 than other body parts.

Due to the overall progressive spring stiffness of the second zone(s) 3—in particular that/those having the channel-like depressions 17—the corresponding body part of the sleeper initially sinks relatively deeply into the second zone 3, to then be substantially supported by the second compression springs 12 of the second spring strand 9 and the second compression springs 12 of the third spring strand 10. The body of the sleeper is thus advantageously supported during sleep at all points so that the sleeper can advantageously sleep restfully. Pleasant haptics for the sleeper may thus also result.

Alternatively, the pocket spring core 1 can also have more than two zones 2, 3 each having different stiffness, wherein each of these zones is constructed either according to the model of the construction of the first zone 2 or according to the model of the construction of one of the second zones 3. It is essential that at least one second zone 3 having reduced stiffness in comparison to the first zone 2 has channel-like depressions 17.

Figure 2:
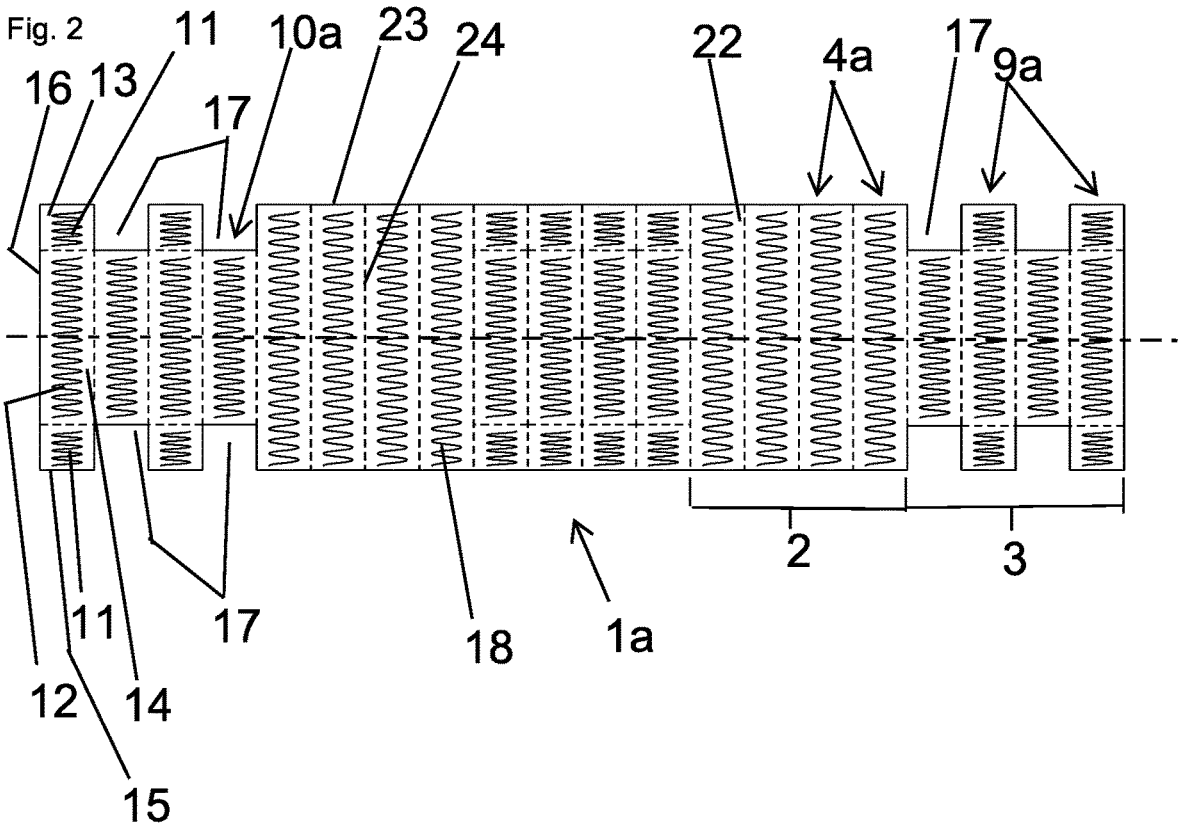
FIG. 2: shows a front view of an embodiment variant of the zoned pocket spring core according to FIG. 1.

FIG. 2 shows a front view of an embodiment variant of the zoned pocket spring core 1 according to FIG. 1. To avoid repetitions, only differences, modifications, or additions to the embodiment of the zoned pocket spring core 1 shown in FIG. 1 and described above are therefore described hereafter.

The first spring strand section 4*a* has a plurality of equivalent, helical wound compression springs 18, which are each inserted individually into one pocket 22 enclosing the individual compression springs 18.

The pocket 22 is produced in each case from a planar textile material, for example, a nonwoven material, wherein the pocket 22—in relation to the plane of the drawing of FIG. 2—is closed in each case by horizontal weld seams 23 and vertical weld seams 24. The weld seams 22, 23 are produced here by an ultrasonic welding method. Alternatively, other welding methods are also possible for producing the weld seams 22, 23.

Notwithstanding the second spring strand section 9 of the second zone 3 in FIG. 1, the second spring strand section 9*a* of the second zone 3*a* having the channel-like depressions 17 has three layers located vertically one over another in relation to the plane of the drawing of FIG. 2, each of a plurality of helical wound compression springs 11, 12.

The layer construction of the spring strand section 9*a* has respectively a first compression spring 11 in a first, upper layer, a second compression spring 12 in a second, middle layer, and a first compression spring 11 in a third lower layer, which are each inserted individually into a pocket 13 enclosing the respective individual first compression spring 11 and a pocket 14 enclosing the respective individual second compression spring 12.

The height of the second spring strand section 9*a*—i.e., its dimension in the vertical direction in relation to the plane of the drawing of FIG. 2—corresponds to the height of the first spring strand 4*a*.

The third spring strand section 10*a* of the second zone(s) 3*a* having the channel-like depressions 17 is constructed similarly to the first spring strand 4*a* here. The third spring strand 10*a* accordingly has a plurality of equivalent, helical wound second compression springs 12 here, which are each inserted individually into a pocket 14 enclosing the individual second compression spring 12 here. Accordingly, the second compression spring 12 of the third spring strand section 10*a* has a lesser turn pitch and a lesser height in comparison to the compression spring 18 of the first spring strand section 4*a*.

Alternatively, the third spring strand section 10*a* can also have multiple layers of compression springs, which are arranged vertically one over another. Each layer has, in this case, a plurality of equivalent, helical wound compression springs, which are each inserted individually into a pocket enclosing the individual compression spring.

It is essential that the height of the third spring strand section 10*a* is less than the height of the first spring strand section 4*a* and also less than the height of the second spring strand section 9*a*.

The second spring strand section 9*a* and the third spring strand section 10*a* are arranged here in a pattern. A simple alternating pattern is selected by way of example in FIG. 2. After a single second spring strand section 9*a*, a single third spring strand section 10*a* thus follows, on which a single second spring strand section 9*a* in turn follows, etc.

Alternatively, other patterns are also possible in the arrangement of the second spring strand section 9*a* and the third spring strand section 10*a* in the second zone(s) having the channel-like depressions 17. It is thus also possible, for example, that the second zone(s) 3*a* having the channel-like depressions 17 has a pattern of in each case one single or multiple successive second spring strand sections 9*a*, which is/are followed by a single or multiple successive third spring strand sections 10*a*.

Due to the pattern, which is formed by the arrangement of the second spring strand section 9*a* and the third spring strand section 10*a*, at least one of the second zone(s) 3*a* of the pocket spring core 1*a* has channel-like depressions 17. Notwithstanding the zoned pocket spring core 1 according to FIG. 1, the channel-like depressions 17 are each located in the vertical direction above and below the second, middle compression spring 12 of the second spring strand section 9*a*. A cost-optimized zoned pocket spring core 1*a* thus advantageously results.

In a further alternative design of the zoned pocket spring core 1*a* according to FIG. 2, it is also possible that the second zone(s) 3*a* having the channel-like depressions 17 is/are constructed from a pattern of alternately arranged second spring strands 9 according to FIG. 1. In this case, the pattern can also in each case have a single or multiple successive second spring strand section(s) 9, in which the depression 17 results above the second compression springs 12 in each case and following this a single or multiple successive second spring strand section(s) 9, in which the depression 17 results below the second compression springs 12 in each case. An advantageously cost-optimized zoned pocket spring core 1*a* may thus result.

The zoned pocket spring core 1*a* has a symmetrical construction with respect to its front view shown in FIG. 2.

Figure 3:
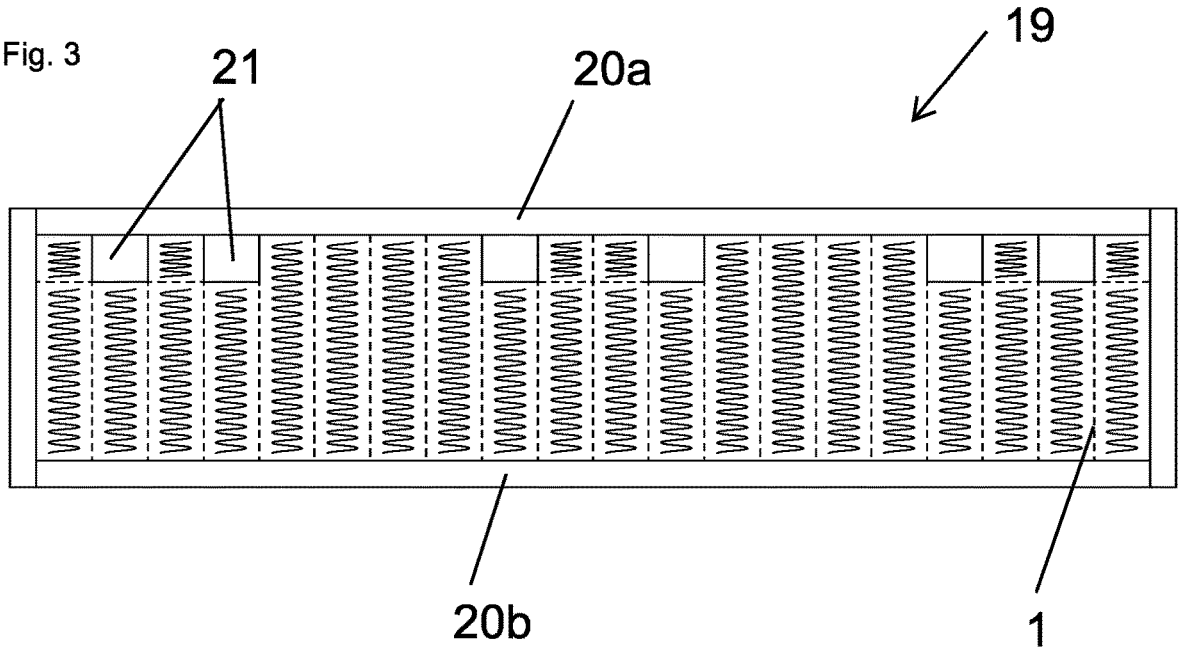
FIG. 3: shows a front view in section of a mattress or a cushion having a zoned pocket spring core according to FIG. 1.

FIG. 3 shows a front view in section of a mattress 19 or a cushion having the zoned pocket spring core 1 according to FIG. 1. To avoid repetitions, only additions which relate to the mattress 19 are described hereafter in relation to the embodiment of the zoned pocket spring core 1 shown in FIG. 1 and described above. The term "mattress" used hereafter also applies synonymously in the scope of the present invention to a cushion, for example, for seating or reclining furniture.

The mattress 19 has, in addition to the zoned spring core 1, a first cushion layer 20*a* and a second cushion layer 20*b*. The cushion layers 20*a*, 20*b* are produced from an elastic material, for example, a foamed plastic, and are respectively arranged above and below the zoned pocket spring core 1 on its entire extension with respect to the plane of the drawing of FIG. 3.

The channel-like depressions 17, which the zoned pocket spring core 1 forms, are covered by the arrangement of the first cushion layer 20*a*, so that the mattress 19 forms duct-like hollow chambers 21. The duct-like hollow chambers 21 preferably extend through the mattress 19 on the entire width of the mattress 19. "Width" means the smaller extension of the reclining surface of the mattress 19. The duct-like hollow chambers 19 absorb by transpiration aqueous secretions of the sleeper formed during sleep, so that the secretions do not remain in the upper cushion layer 20*a* and can thus evaporate faster. A mattress 19 having advantageously improved hygienic properties thus results.

The mattress 19 is furthermore completely enveloped using a textile cover material (not shown here).

Figure 4:
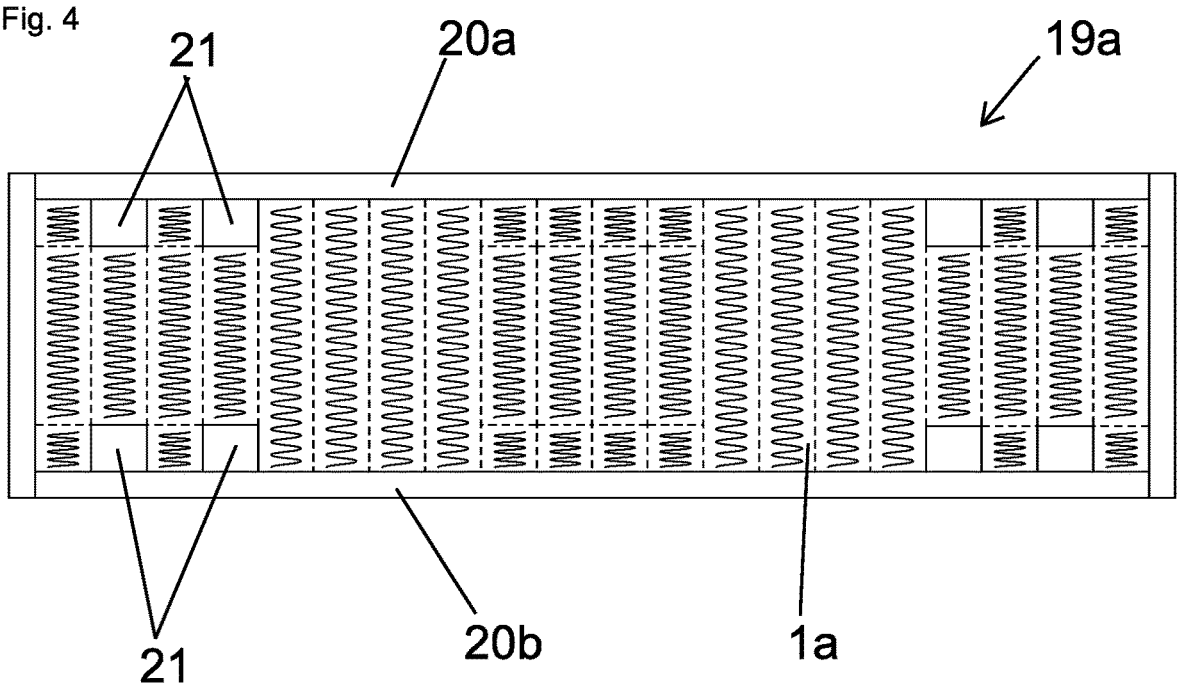
FIG. 4: shows a front view in section of a mattress or a cushion having a zoned pocket spring core according to FIG. 2.

FIG. 4 shows a front view in section of an embodiment variant of the mattress 19 or a cushion according to FIG. 3 having the zoned pocket spring core 1*a* according to FIG. 2. To avoid repetitions, only additions which relate to the mattress 19*a* according to FIG. 4 are described hereafter in relation to the embodiment of the zoned pocket spring core 1*a* shown in FIG. 2 and described above. The term "mattress" used hereafter also applies synonymously in the scope of the present invention to a cushion, for example, for seating or reclining furniture.

The mattress 19*a* has, in addition to the zoned spring core 1*a*, a first cushion layer 20*a* and a second cushion layer 20*b*. The cushion layers 20*a*, 20*b* are produced from an elastic material, for example, a foamed plastic, and are respectively arranged above and below the zoned pocket spring core 1*a* on its entire extension with respect to the plane of the drawing of FIG. 4. The mattress 19*a* shown in FIG. 4 is also referred to as a so-called reversible mattress in the technical language, since it is constructed symmetrically with respect to the front view (see FIG. 4). Furthermore, the mattress 19*a* can have different cover materials on each of its reclining sides, which define, for example, a "summer side" and a "winter side".

The channel-like depressions 17, which the zoned pocket spring core 1*a* forms, are covered by the arrangement of the first cushion layer 20*a*, so that the mattress 19*a* forms duct-like hollow chambers 21*a*. Notwithstanding the mattress 19 according to FIG. 3, the mattress 19*a* has the duct-like hollow chambers 21, similar to the channel-like depressions 17 of the zoned pocket spring core 1*a*, in each case vertically below the first cushion layer 26*a* and vertically above the second cushion layer 26*b*.

The duct-like hollow chambers 21 absorb by transpiration aqueous secretions of the sleeper formed during sleep, so that the secretions do not remain in the upper cushion layer 20*a* and can thus evaporate faster. A mattress 19*a*—a reversible mattress here—having advantageously improved hygienic properties on both reclining sides thus results.

The following method is specified for producing the zoned pocket spring core 1, la:

Firstly, wire for the compression springs 5, 11, 12, 18, the textile material for the pockets 6, 13, 14, 22, a machine for the automated manufacturing of endless spring strands from pocketed springs, a machine for severing the spring strands and the alignment, layering, and adhesive bonding of spring strand sections and also adhesive for adhesive bonding of the spring strand sections 4, 4*a*, 9, 9*a*, 10, 10*a* are provided.

In a following method step, the compression springs 5, 18 are wound from the wire by the machine for automated manufacturing of endless spring strands from pocketed springs and inserted into a pocket 6, 22, which is open on at least one side and is formed by the weld seams 7, 8, 23, 24 of a welding method, made of the textile material and the pocket 6, 22 is closed by a weld seam 7, 8, 23, 24 and the first spring strand of pocketed compression springs 5, 18 is thus produced.

In a further method step, the first compression springs 11 and the second compression springs 12 are each wound by the machine and each inserted into a pocket 13, 14, which is open on at least one side and is formed by the weld seams 15, 16 of a welding method, and the respective pocket 13, 14 is closed by a weld seam 15, 16 and the second spring strand of pocketed compression springs 11, 12 arranged vertically one over another is thus produced. This method step preferably takes place on a second machine chronologically in parallel to the preceding method step.

In a following method step, the second compression spring 12 is wound from the wire by the machine and inserted into a pocket 14, which is open on at least one side and formed by the weld seams 15, 16 of a welding method, made of the textile material and the pocket 14 is closed by a weld seam 15, 16 and the third spring strand of pocketed compression springs 12 is thus produced. This method step preferably takes place on a second machine chronologically in parallel to the two preceding method steps.

In a following method step, the respective endless spring strand sections are severed in the machine for the severing of the spring strands and the alignment, layering, and adhesive bonding of spring strand sections 4, 4*a*, 9, 9*a*, 10, 10*a* and the spring strand sections 4, 4*a*, 9, 9*a*, 10, 10*a* thus resulting are aligned, juxtaposed to form a defined pattern, and adhesively bonded to one another, so that the zoned pocket spring core 1, 1*a* having at least one first zone 2 and one second zone 3 is formed, wherein at least one zone 3 of the at least two zones 2, 3 has channel-like depressions 17.

The manufacturing of the zoned pocket spring core 1, la is advantageously simplified by the specified method. A cost-effective zoned pocket spring core 1, la thus advantageously results.

The invention claimed is:

1. A pocket spring core having at least one first zone and at least one second zone, wherein the at least one first zone includes at least two rows of a first spring strand section including a first plurality of helically wound compression springs arranged in a single layer, each of the first plurality of helically wound compression springs having a first spring constant, wherein at least one of the at least one second zone includes at least one row of a second spring strand section and at least one row of a third spring strand section, wherein the at least one row of a second spring strand section includes a second plurality of helically wound compression springs arranged in a first layer, and a third plurality of helically wound compression springs arranged in a second layer located vertically over the first layer, each of the second plurality of helically wound compression springs having a second spring constant and each of the third plurality of helically wound compression springs having a third spring constant, wherein the third spring constant is different from the second spring constant, and wherein ones of the second plurality of helically wound compression springs and corresponding ones of the third plurality of helically wound compression springs are operable in combination, the combination having a progressive spring rate, wherein the at least one row of a third spring strand section includes a fourth plurality of helically wound compression springs arranged in a first layer, each of the fourth plurality of helically wound compression springs having a fourth spring constant, a fifth plurality of springs arranged in a second layer located vertically over the first layer, and a sixth plurality of springs arranged in a third layer located vertically over the second layer, wherein a height of the at least one row of a third spring strand section is less than a height of the at least two rows of a first spring strand section and less than a height of the at least one row of a second spring strand section, and wherein the at least one row of a third spring strand section cooperates with at least one of the at least two rows of a first spring strand section and the at least one of a second spring strand section to define at least one channel-like depression.

2. The pocket spring core according to claim 1, wherein the at least one channel-like depression extends through an entire width of the pocket spring core.

3. The pocket spring core according to claim 1, wherein the at least one row of a second spring strand section includes a seventh plurality of helically wound compression springs located vertically over one or both of the second and third pluralities of helically wound compression springs.

4. The pocket spring core according to claim 1, wherein the height of the second spring strand section corresponds to the height of the first spring strand section.

5. The pocket spring core according to claim 1, wherein the helically wound compression springs are each inserted individually into a pocket enclosing the individual helically wound compression springs.

6. The pocket spring core according to claim 5, wherein the pocket is produced in each case from a planar textile material, in particular from nonwoven material.

7. The pocket spring core according to claim 5, wherein the pocket is closed in each case by horizontal weld seams and vertical weld seams.

8. The pocket spring core according to claim 7, wherein the weld seams are produced by an ultrasonic welding method.

9. The pocket spring core according to claim 1, wherein the at least one second zone has a pattern of in each case a single or multiple successive second spring strand section(s), on which a single or multiple successive third spring strand section(s) follows/follow.

10. A mattress or cushion having a pocket spring core according to claim 1, and a first cushion layer, which is arranged vertically above the pocket spring core, and a second cushion layer, which is arranged vertically below the pocket spring core, wherein the mattress or the cushion forms duct-like hollow chambers between the pocket spring core and the first cushion layer.

11. The mattress or cushion according to claim 10, wherein the mattress or the cushion forms duct-like hollow chambers between the pocket spring core and the first cushion layer and the second cushion layer.

12. The mattress or cushion according to claim 10, wherein the duct-like hollow chambers extend through the mattress on an entire width of the mattress.

13. The mattress or cushion according to claim 10, wherein the mattress is completely enveloped using a textile cover material.

14. A mattress or cushion comprising:

a pocket spring core according to claim 1;

a first cushion layer arranged vertically above the pocket spring core; and a second cushion layer arranged vertically below the pocket spring core, wherein the mattress or cushion forms duct-like hollow chambers between the pocket spring core and the first cushion layer.

15. A method for producing a pocket spring core having at least one first zone and at least one second zone, wherein the at least one first zone includes at least two rows of a first spring strand section including a first plurality of helically wound compression springs arranged in a single layer, each of the first plurality of helically wound compression springs having a first spring constant, wherein at least one of the at least one second zone includes at least one row of a second spring strand section and at least one row of a third spring strand section, wherein the at least one row of a second spring strand section includes a second plurality of helically wound compression springs arranged in a first layer, and a third plurality of helically wound compression springs arranged in a second layer located vertically over the first layer, each of the second plurality of helically wound compression springs having a second spring constant and each of the third plurality of helically wound compression springs having a third spring constant, wherein the third spring constant is different from the second spring constant, and wherein ones of the second plurality of helically wound compression springs and corresponding ones of the third plurality of helically wound compression springs are operable in combination, the combination having a progressive spring rate, wherein the at least one row of a third spring strand section includes a fourth plurality of helically wound compression springs, each of the fourth plurality of helically wound compression springs having a fourth spring constant, wherein the at least one row of a third spring strand section includes a fourth plurality of helically wound compression springs arranged in a first layer, each of the fourth plurality of helically wound compression springs having a fourth spring constant, a fifth plurality of springs arranged in a second layer located vertically over the first layer, and a sixth plurality of springs arranged in a third layer located vertically over the second layer, wherein a height of the at least one row of a third spring strand section is less than a height of the at least two rows of a first spring strand section and less than a height of the at least one row of a second spring strand section, and wherein the at least one row of a third spring strand section cooperates with at least one of the at least two rows of a first spring strand section and the at least one of a second spring strand section to define at least one channel-like depression, the method comprising the steps of:

a) providing wire, a textile material, a machine for automated manufacturing of endless spring strands from pocketed springs, a machine for the severing of the spring strands and the alignment, layering, and adhesive bonding of spring strand sections, and adhesive;

b) producing a first spring strand of pocketed compression springs;

c) producing a second spring strand of pocketed compression springs arranged vertically one over another;

d) producing a third spring strand of pocketed compression springs arranged vertically one over another;

e) severing the respective spring strand of pocketed compression springs into the respective spring strand sections and aligning, juxtaposing to form a defined pattern, and adhesively bonding the spring strand sections to form a pocket spring core so that the zoned pocket spring core is formed having at least one first zone and one second zone, wherein at least one of the first zone(s) of the at least two zones has channel-like depressions.

* * * * *